United States Patent [19]

Maliszewski

[11] 4,372,496

[45] Feb. 8, 1983

[54] ELECTRONIC CONTROLLER OF HYDRAULIC PRESSURE FOR JOURNAL LOADING OF BOWL MILL

[75] Inventor: Theodore V. Maliszewski, North Canton, Conn.

[73] Assignee: Combustion Engineering, Inc., Windsor, Conn.

[21] Appl. No.: 192,774

[22] Filed: Oct. 1, 1980

[51] Int. Cl.[3] ..... B02C 4/32

[52] U.S. Cl. ..... 241/37; 241/109; 241/121

[58] Field of Search ..... 241/33, 37, 109, 117, 241/119, 121, 122

[56] References Cited

U.S. PATENT DOCUMENTS

| | | | |
|---|---|---|---|
| 2,909,330 | 10/1959 | Hardinge | 241/37 |
| 3,591,094 | 7/1971 | Gauer | 241/37 |
| 4,002,299 | 1/1977 | Skalka | 241/37 |

*Primary Examiner*—Mark Rosenbaum
*Assistant Examiner*—Timothy V. Eley
*Attorney, Agent, or Firm*—Arthur E. Fournier, Jr.

[57] ABSTRACT

An electronic system particularly suited for effecting control over the pressure of the hydraulic fluid through which the journal loading is established on the grinding rolls (20) of a bowl mill (10) of the type that is employed to pulverize coal. The subject electronic system is operatively connected in circuit relation to the belt feeder means (12), located externally of the bowl mill (10), that supplies to the bowl mill (10) the coal that is to be pulverized therein. In addition, the subject electronic system is also operatively connected in circuit relation to the hydraulic power unit (22) of the bowl mill (10) that provides hydraulic fluid under pressure to the grinding rolls (20). Accordingly, the subject electronic system is operative to monitor both the rate at which coal is fed to the bowl mill (10) and the pressure of the hydraulic fluid supplied to the grinding rolls (20) such that as the feed rate of the coal varies the hydraulic pressure being applied to the grinding rolls (20) can be made to vary so that the grinding forces that the grinding rolls (20) exert can be maintained substantially as an optimum regardless of the rate at which the coal is being fed to the bowl mill (10).

10 Claims, 1 Drawing Figure

ELECTRONIC CONTROLLER OF HYDRAULIC PRESSURE FOR JOURNAL LOADING OF BOWL MILL

BACKGROUND OF THE INVENTION

This invention relates to control systems, and more specifically, to an electronic system in the form of a controller suitable for embodiment in a pulverizing mill for purposes of controlling the journal loading on the grinding, i.e., pulverizing, rolls of the mill in accordance with the rate of feed to the mill of the material that is to be pulverized therewithin.

An essential component of any steam generation system of the type, which utilizes pulverized coal as a fuel, is the apparatus in which the coal is pulverized so as to render it suitable for such usage. Although the prior art is known to have employed various types of apparatus for purposes of accomplishing coal pulverization, one form of apparatus in particular, which has frequently been used for this purpose, is that commonly referred to as a bowl mill by those in the industry. The bowl mill obtains its name principally from the fact that the pulverization, i.e., grinding, of the coal that takes place therewithin occurs on a grinding surface which in configuration somewhat resembles a bowl.

By way of illustration, reference may be had to U.S. Pat. No. 3,465,971, which is assigned to the same assignee as the present invention, for a showing of a prior art form of bowl mill. This patent contains a teaching of both the nature of the construction and the mode of operation of a bowl mill that is suitable for use for purposes of effecting the pulverization of the coal that is used to fuel a coal-fired steam generator. As taught by this patent, the essential components of such a bowl mill are a body portion, i.e., housing, within which a grinding table is mounted for rotation, a plurality of grinding rolls that are supported in equally spaced relation one to another in a manner so as to coact with the grinding table such that the coal disposed on the surface of the grinding table is capable of being ground, i.e., pulverized, by the rolls, coal supply means for feeding to the surface of the grinding table the coal that is to be pulverized in the bowl mill, and air supply means for providing to the interior of the body portion the air that is required for the operation of the bowl mill.

In order to satisfy the demands of a coal-fired steam generation system of conventional construction for pulverized coal a multiplicity of bowl mills of the type shown in the aforereferenced patent are commonly required to be employed. Further in this regard it is noted that the individual capacity of each of these bowl mills may range up to a capacity of one hundred tons of pulverized coal per hour. In addition to possessing a capability of operating at their maximum capacity, these bowl mills must also have the ability to operate at less than full capacity, i.e., at some percentage thereof, e.g., 25%, 50%, 75%, etc. Accordingly, this fosters a further requirement that the bowl mill be capable of exerting the requisite degree of grinding force regardless of the rate of output at which the bowl mill is operating. Here note is taken of the fact that variations in the output provided from the bowl mill are normally accomplished by varying the amount of coal that is fed to the grinding table, while the speed of rotation of the grinding table is made to remain substantially constant.

The depth of coal that is disposed on the grinding table is a function of the output rate at which the bowl mill is performing. In addition, the depth of coal that is present on the grinding table has an effect on the amount of grinding force being exerted on the coal by the grinding rolls. Obviously, therefore, it is important that if the grinding rolls are to apply the requisite degree of force needed to effect the pulverization of the coal, consideration must be given to the existence of this relationship between the grinding force exerted by the grinding rolls and the depth of the coal on the grinding table.

Originally, the journal loading, which dictates the amount of grinding force that the grinding rolls exert on the coal, was provided through the use of mechanical springs. One arrangement of this type can be found depicted, for example, in the patent which was referred to above previously. In accord with the showing contained in this U.S. patent, each grinding roll is urged towards the surface of the grinding table by means of an adjustable spring. To this end, there is selected for use for this purpose, a mechanical coil spring that possesses the design characteristics desired; namely, a spring that is capable of urging the grinding roll toward the grinding table surface in such a manner that the grinding roll exerts a predetermined grinding force on the coal disposed on the table, when the coal is of a preselected depth on the table.

It was found, however, that there were at least two significant disadvantages associated with the use of mechanical coil springs for purposes of providing the journal loading on the grinding rolls of a bowl mill. The first of these is of relatively recent vintage and has its origin in the fact that the size of the lastest bowl mills is such as to require coil springs that must be capable of exerting tremendous forces. The problem that has surfaced in this regard is not one of design, but rather has to do with the manufacturing of the coil springs. Namely, difficulties have been encountered in regard to satisfying the existing quality assurance standards for such mechanical coil springs. The result has been that these coil springs, as manufactured, do not always embody the specifications that have been set therefor. Accordingly, variations are found to occur as between the grinding forces exerted by each of the grinding rolls in a given bowl mill. In addition, the designed value of the grinding force that has been established for a particular grinding roll is often not attached. Such variations in the amount of grinding force being exerted by the grinding rolls has led to instances wherein the level of performance of the bowl mill is deemed to be unsatisfactory. That is, the coal has not been pulverized properly because the grinding rolls have not exerted the requisite grinding force. This in turn can have an adverse effect on the operation of the entire coal-fired steam generation system.

The other disadvantage from which bowl mills equipped with mechanical coil springs have been known to suffer is the fact that it is very difficult, if not impossible, therewith to adjust the amount of grinding force that the grinding rolls exert on the coal that is being pulverized. The reason for this lies principally in the fact that each coil spring can only be made to have one spring constant. Moreover, once the coil spring has been made to have a certain spring constant, the latter remains essentially fixed from then on. Basically, a two-step procedure is followed in establishing what the spring constant should be for a particular coil spring. Namely, the amount of grinding force that the grinding roll needs to apply to the coal in order to effect the desired degree of pulverization of the latter under a specified set of operating parameters is determined. From this, it is possible to determine what the journal loading should be on the grinding roll in order to have the latter provide such a grinding force. The proper spring constant is then selected, which will enable the establishment by the coil spring of such a journal loading on the grinding roll.

Unfortunately, as alluded to above, the amount of grinding force that a particular grinding roll should exert on the coal is a function of a number of variables, e.g., the output rate at which the bowl mill is operating and concomitantly therewith the depth of coal that is disposed on the grinding table surface, the nature of the coal that is being pulverized, etc. Any change in any of these variables can necessitate an adjustment in the amount of grinding force being applied to the coal by the grinding roll. Thus, for purposes of making the original determination of the spring constant for the coil spring, a particular set of operating parameters are assumed. This assumed set of parameters are designed to most nearly represent those that most frequently will prevail when the bowl mill is operating. In summary, it is possible when utilizing mechanical coil springs to select a spring constant that will enable the grinding rolls to exert an optimum amount of grinding force under a given set of operating parameters. However, any change in these parameters occasioned by the operating requirements of the steam generation system of which the bowl mill forms a part that leads to a need to adjust the grinding force being exerted by the grinding rolls will mean that the bowl mill will be forced to operate in a condition wherein either less or more than the optimum amount of grinding force is being applied by the grinding rolls. This results from the inability to change the spring constant of the coil springs.

In an effort to obviate the disadvantages associated with the use in bowl mills of mechanical coil springs for purposes of establishing the journal loading on the grinding rolls thereof, the prior art has turned as a possible replacement to the employment of hydraulic systems. U.S. Pat. No. 4,002,299 is directed to one arrangement of such a hydraulic system. In accord with the teachings of this patent, a system is provided wherein the grinding rolls have a hydraulic loading applied thereto. More specifically, the hydraulic loading on the grinding rolls is established by means of hydraulic fluid that is fed under pressure to the grinding rolls. Moreover, through the use of a servo system, changes in the hydraulic pressure are automatically effected as the mill output increases or decreases.

Although hydraulically loading the grinding rolls of the bowl mill has obviated the problem discussed above relating to the matter of meeting quality assurance standards in the manufacture of mechanical coil springs, it has introduced a new and different problem. Namely, a characteristic of the servo systems employed in connection with the establishment of the hydraulic loading on the grinding rolls in bowl mills is the susceptibility of such servo systems to the phenomenon known as hunting. Inasmuch as those skilled in the art of servo systems are well acquainted with this phenomenon, it is not deemed necessary to discuss it at length herein. Rather, it is deemed sufficient to merely note that hunting is that phenomenon wherein the servo system in its attempt to effect the establishment of the proper hydraulic pressure continually signals the need for minor corrective adjustments to be made in the hydraulic pressure. To this end, each time the servo system senses a deviation from the desired pressure level, it signals the need for corrective action to be taken. This corrective action instituted by the servo system in turn elicits from the latter the need for a further change. This process, which may go on ad infinitum, is what is referred to herein as the phenomenon of hunting.

In addition to being disadvantageously characterized by virtue of their susceptibility to hunting, as discussed above, the systems that have been suggested to date by the prior art for purposes of hydraulically loading the grinding rolls in a bowl mill have in general also suffered from a further disadvantage. Reference is had here to the fact that as in the case of mechanical coil springs, most, if not all, of the hydraulic systems that have been suggested for use by the prior art in connection with establishing the loading on the grinding rolls in a bowl mill are unsuitable for use for purposes of effecting changes in the amount of grinding force that the rolls exert. That is, the mode of operation of these prior art forms of hydraulic systems is such that they are intended to ensure that a fixed value of hydraulic pressure is continually applied to the grinding rolls in the form of the journal loading thereon.

The difficulty arises here from the fact that as in the case of the spring constant of coil springs, although a particular value of hydraulic pressure may be selected so as to cause the grinding rolls to exert the optimum amount of grinding force for a particular set of operating parameters, as the latter parameters vary in the course of the operation of the bowl mill, the value of the pressure of the hydraulic fluid being fed to the grinding rolls may not necessarily be the same as that which should be present to ensure that the grinding rolls are still exerting the optimum amount of grinding force under this changed set of operating parameters. Moreover, like the spring constant of the coil spring, once the value of the pressure of the hydraulic fluid that is to be supplied to the grinding rolls is established, in accord with the mode of operation of most, if not all, of these prior art forms of hydraulic systems, this value for the hydraulic pressure cannot be changed. That its, changes cannot be effected in the established value for the pressure of the hydraulic fluid in accordance with the need to vary the amount of grinding force that the grinding rolls are required to exert in order to pulverize to the desired extent the coal that is disposed on the grinding table surface.

A need has thus existed in the prior art for a new and improved means for providing the journal loading on the grinding rolls of a bowl mill. Moreover, a need has been demonstrated for a means that would enable the amount of grinding force being exerted by the grinding rolls to be varied as the need therefor may be occasioned by changes in the operating parameters of the bowl mill. Finally, a need has been shown for such a means which would not suffer from the same difficulties that have served to disadvantageously characterize the operation of bowl mills equipped either with mechanical coil springs or a hydraulic system of the prior art type.

It is, therefore, an object of the present invention to provide a new and improved means operable for establishing the journal loading on the grinding rolls of a bowl mill that is suitable for use to pulverize coal.

It is another object of the present invention to provide such a means that is operative to establish a hydraulic loading on the grinding rolls of a bowl mill suitable for use to pulverize coal.

It is still another object of the present invention to provide such a means in the form of an electronic controller that is operative for purposes of effecting control over the hydraulic loading that is applied to the grinding rolls of the bowl mill.

A further object of the present invention is to provide such an electronic controller that is capable of obviating the problem involving the failure to meet quality assurance standards that has served to disadvantageously characterize the mechanical coil springs that have been employed heretofore for purposes of establishing the journal loading on the grinding rolls in a bowl mill.

A still further object of the present invention is to provide such an electronic controller that is capable of obviating the problem involving susceptibility to hunting that has served to disadvantageously characterize the hydraulic systems that have been employed heretofore for purposes of establishing the journal loading on the grinding rolls in a bowl mill.

Yet another object of the present invention is to provide such an electronic controller that enables adjustments to be made in the amount of grinding force being exerted by the grinding rolls in order to compensate for the occurrence of changes in the operating parameters of the bowl mill.

Yet still another object of the present invention is to provide such an electronic controller that is relatively simple to construct and employ, as well as being relatively inexpensive to provide.

SUMMARY OF THE INVENTION

In accordance with the present invention there is provided an electronic controller that is operable to control the pressure of the hydraulic fluid through which the journal loading is established on the grinding rolls of a bowl mill of the type that is suitable for use to pulverize coal. The subject electronic controller includes input means, a scaling transducer, a converter card, a controller station, a power supply, a pressure transmitter, hydraulic interconnection means, and an output means. The input means is connected in circuit relation with the belt feeder means that supplies the bowl mill with coal, and is operable to receive a signal from the belt feeder means corresponding to the rate of feed at which the belt feeder means is operating. This signal received by the input means is fed therefrom to the scaling transducer wherein the signal is transposed to a suitable scale for purposes of further processing. Thereafter, the signal is fed on to the converter card whereat further processing thereof takes place. Finally, the signal is fed as one input to the controller station. The electrical power required for the operation of the scaling transducer, the converter card and the controller station is obtained from the power supply that is provided for this purpose. The hydraulic interconnection means is connected in fluid flow relation to the hydraulic power unit of the bowl mill, the latter comprising the unit through which hydraulic fluid under pressure is supplied to the grinding rolls. The function of the hydraulic interconnection means is to provide a reference point in terms of the pressure of the hydraulic fluid at the hydraulic power unit. The pressure sensed by the former is fed to the pressure transmitter and therefrom to the controller station in the form of an input to the latter. Based on the input derived from the belt feeder means that is received at the controller station, and the input derived from the hydraulic power unit that is also received at the controller station, an output signal is generated at the controller station. This output signal is fed to the output means, which is connected in circuit relation to the hydraulic power unit. In accordance with the nature of the output signal that is received by the hydraulic power unit, the pressure of the hydraulic fluid being fed to the grinding rolls may be caused to increase, decrease, or remain the same thereby producing a concomitant increase, decrease, or no change in the amount of grinding force that the grinding rolls exert on the coal that is disposed on the grinding table surface.

DESCRIPTION OF A PREFERRED EMBODIMENT

Figure 1:
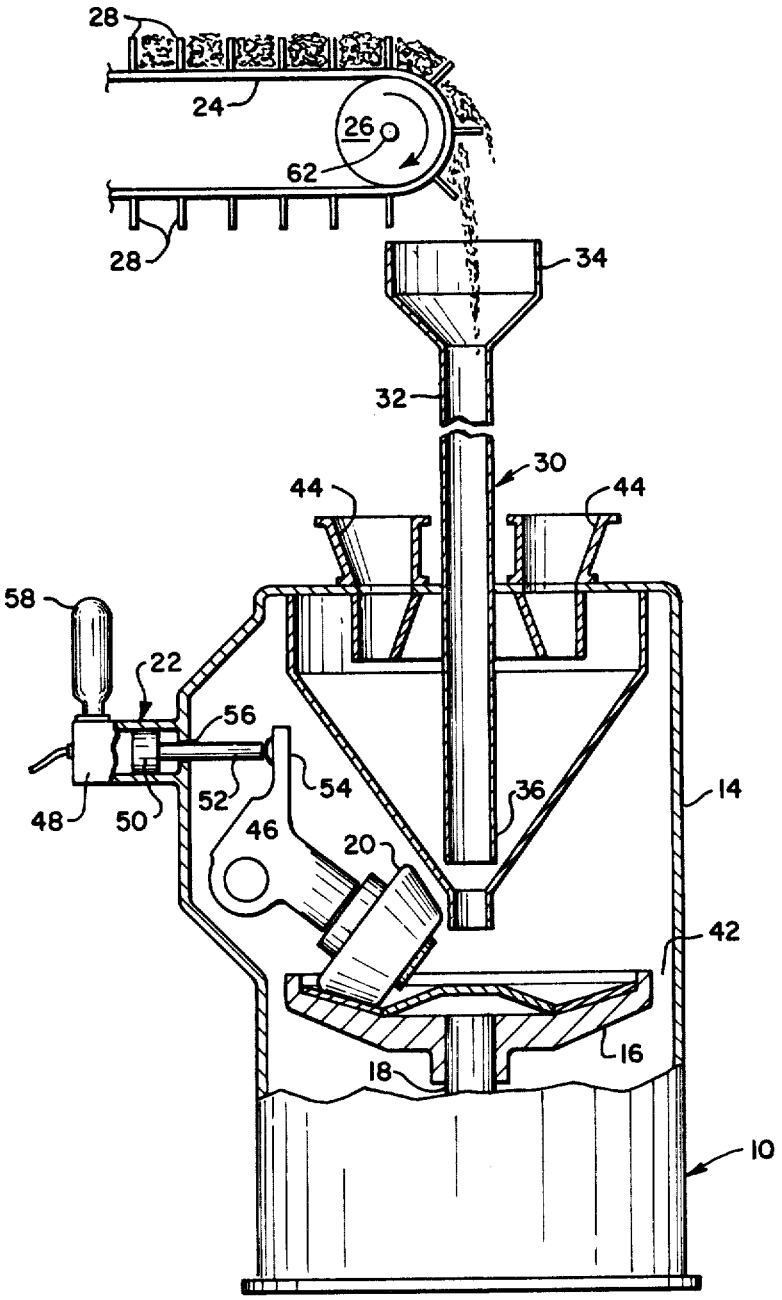
FIG. 1 is a side elevational view partly in section and with some parts broken away of a bowl mill embodying an electronic controller constructed in accordance with the present invention, and illustrated cooperatively associated with a belt feeder means.

Referring now to the drawing, and more particularly to FIG. 1 thereof, a pulverizing bowl mill, generally designated by reference numeral 10 is depicted therein cooperatively associated with a belt feeder means, the latter being generally designated therein by reference numeral 12. Inasmuch as the nature of the construction and the mode of operation of pulverizing bowl mills per se are well-known to those skilled in the art, it is not deemed necessary, therefore, to set forth herein a detailed description of the pulverizing bowl mill 10 illustrated in FIG. 1 of the drawing. Rather, it is deemed sufficient for purposes of obtaining an understanding of a pulverizing bowl mill 10, that is equipped with an electronic controller constructed in accordance with the present invention, that there be presented herein merely a description of the nature of the construction and the mode of operation of the components of the pulverizing bowl mill 10 and the belt feeder means 12, with which the aforesaid electronic controller cooperates. For a more detailed description of the nature of the construction and the mode of operation of the components of the pulverizing bowl mill 10, which are not described in depth herein, one may have reference to the prior art, e.g., U.S. Pat. No. 3,465,971, which issued Sept. 9, 1969 to J. F. Dalenberg et al., and /or U.S. Pat. No. 4,002,299, which issued Jan. 11, 1977 to C. J. Skalka.

Referring further to FIG. 1 of the drawing, the pulverizing bowl mill 10 as illustrated therein includes a substantially closed separator body 14. A grinding table 16 is mounted on a shaft 18, which in turn is operatively connected to a suitable drive mechanism (not shown) so as to be capable of being rotatably driven thereby. With the aforesaid components arranged within the separator body 14 in the manner depicted in FIG. 1 of the drawing, the grinding table 16 is designed to be driven in a clockwise direction.

Continuing with a description of the pulverizing bowl mill 10, a plurality of grinding rolls 20, preferably three in number in accordance with the best mode embodiment of the invention, are suitably supported within the interior of the separator body 14 so as to be spaced equidistantly one from another around the circumference of the latter. In the interest of maintaining clarity of illustration in the drawing, only one such grinding roll 20 has been shown in FIG. 1. With further regard to the grinding rolls 20, each of the latter as best understood with reference to FIG. 1 of the drawing is preferably supported on a suitable shaft (not shown) for rotation relative thereto. Further, the grinding rolls 20 are each suitably supported in a manner yet to be described for movement relative to the upper surface, as viewed with reference to FIG. 1, of the grinding table 16. To this end, each of the grinding rolls 20 has a hydraulic means, generally designated in FIG. 1 by reference numeral 22, cooperatively associated therewith. Each of the hydraulic means 22 is operative, as will be described more fully hereinafter, to establish a hydraulic loading on the corresponding grinding roll 20 whereby the latter may be made to exert the requisite degree of force on the coal that is disposed on the grinding table 16 for purposes of accomplishing the desired pulverization of this coal. The manner in which and the means whereby control is exercised over the hydraulic loading that is applied to the grinding rolls 20 comprises the essence of the subject matter which forms the present invention, and is described in detail hereinafter.

The material, i.e., coal, that is to be pulverized in the bowl mill 10 is fed thereto by means of the belt feeder means 12. In accordance with the illustration thereof to be found in FIG. 1 of the drawing, the belt feeder means 12 consists of an endless belt 24, that is made to pass around a pair of rollers 26, only one of which can be seen in FIG. 1. Any suitable conventional form of drive means (not shown) may be employed for purposes of imparting drive to the rollers 26, and therethrough to the endless belt 24. Preferably, as shown in FIG. 1, the endless belt 24 is provided with a plurality of upstanding members 28 that extend at right angles to the plane of movement of the belt 24. The effect of these members 28 is to essentially compartmentalize the surface of the belt 24. Although not shown in FIG. 1, it is to be understood that the end of the belt 24 not depicted therein is made to pass in juxtaposed relation to a suitable supply of coal (not shown). Moreover, in the course of its passage in proximity to the coal supply (not shown) coal is fed in any suitable manner, e.g., by gravity, etc. onto the endless belt 24. Thereafter, the coal is conveyed by means of the belt 24 to a position whereupon, as depicted in FIG. 1, as the belt 24 commences its return run the coal under the influence of gravity falls freely away from the surface of the belt 24.

Upon falling free of the endless belt 24, the coal enters the bowl mill 10 by means of a coal supply means, generally designated by reference numeral 30, with which the separator body 14 is suitably provided. In accordance with the embodiment of the pulverizing bowl mill 10 illustrated in FIG. 1, the coal supply means 30 includes a suitably dimensioned duct 32 having one end thereof which extends outwardly of the separator body 14 and preferably terminates in a funnel-like member 34. The latter member 34 is suitably shaped so as to facilitate the collection of the coal particles leaving the belt 24, and the guiding thereafter of these coal particles into the duct 32. The other end 36 of the duct 32 of the coal supply means 30 is operative to effect the discharge of the coal onto the surface of the grinding table 16. To this end, as shown in FIG. 1 of the drawing, the duct end 36 preferably is suitably supported within the separator body 14 through the use of any suitable form of conventional support means (not shown) such that the duct end 36 is coaxially aligned with the shaft 18 that supports the grinding table 16 for rotation, and is located in spaced relation to a suitable outlet 38 provided in the classifier, generally designated by reference numeral 40, through which the coal flows in the course of being fed onto the surface of the grinding table 16.

In accord with the mode of operation of pulverizing bowl mills that embody the form of construction depicted in FIG. 1, a gas such as air is utilized to effect the conveyance of the coal from the grinding table 16 through the interior of the separator body 14 for discharge from the pulverizing bowl mill 10. The air provided for this purpose enters the separator body 14 through a suitable opening (not shown) provided therein for this purpose. From the aforesaid opening (not shown) in the separator body 14 the air flows to a multiplicity of annular spaces 42 suitably formed between the circumference of the grinding table 16 and the inner wall surface of the separator body 14. The air upon exiting from the annular spaces 42 is deflected over the grinding table 16 by means of suitably positioned deflector means (not shown). One such form of deflector means (not shown), which is suitable for use for this purpose in the bowl mill 10 of FIG. 1, comprises the subject matter of copending patent application, Ser. No. 41,155, which was filed on May 21, 1978, now U.S. Pat. No. 4,234,132, in the name of the same inventor as the present application, and which has been assigned to the same assignee as the present application.

While the air is flowing along the path described above, the coal which is disposed on the surface of the grinding table 16 is being pulverized by the action of the grinding rolls 20. As the coal becomes pulverized, the particles are thrown outwardly by centrifugal force away from the center of the grinding table 16. Upon reaching the area of the circumference of the grinding table 16, the coal particles are picked up by the air exiting from the annular spaces 42 and are carried along therewith. The combined flow of air and coal particles is thereafter captured by the deflector means (not shown), which has been referred to previously hereinabove. The effect of this is to cause the combined flow of air and coal particles to be deflected over the grinding table 16. This necessitates a change in direction in the path of flow of this combined stream of air and coal particles. In the course of effecting this change of direction, the heaviest coal particles, because they have more inertia, become separated from the air stream and fall back onto the circumference of the grinding tables 16, whereupon they undergo further pulverization. The lighter coal particles, on the other hand, because they have less inertia continue to be carried along in the air stream.

After leaving the influence of the aforesaid deflector means (not shown), the combined stream of air and coal particles that remain flow to the classifier 40 to which mention has previously been had hereinbefore. The classifier 40, in accord with conventional practice and in a manner which is well-known to those skilled in this art, operates to effect a further sorting of the coal particles that remain in the air stream. Namely, those particles of pulverized coal, which are of the desired particle size, pass through the classifier 40 and along with the air are discharged therefrom and thereby from the bowl mill 10 through the outlets 44 with which the latter is provided for this purpose. On the other hand, those coal particles which in size are larger than desired are returned to the surface of the grinding table 16 whereupon they undergo further pulverization. Thereafter, these coal particles are subject to a repeat of the process described above. That is, the particles are thrown outwardly of the grinding table 16, are picked up by the air exiting from the annular spaces 42, are carried along with the air to the deflector means (not shown), are deflected back over the grinding table 16 by the deflector means (not shown), the heavier particles drop back on the grinding table 16, the lighter particles are carried along the classifier 40, those particles which are of the proper size pass through the classifier 40 and exit from the bowl mill 10 through the outlets 44.

With further regard to the matter of the pulverizing action to which the coal disposed on the upper surface of the grinding table 16, as viewed with reference to FIG. 1, is subjected by the grinding rolls 20, the amount of force that must be exerted by the latter in order to effect the desired degree of pulverization of the coal will vary depending on a number of factors. Mention of this was made herein in the course of a discussion of the known prior art, and the concomitant need that has been demonstrated for a bowl mill embodying an electronic controller constructed in accordance with the present invention. Simply stated, however, the amount of force that the grinding rolls 20 must exert in order to accomplish the desired pulverization of the coal can be said to be principally a function of the amount, i.e., depth, of coal that is present on the grinding table 16. In turn, the amount of coal which is disposed on the grinding table 16 is dependent upon the output rate at which the bowl mill 10 is operating to produce pulverized coal.

As best understood with reference to FIG. 1 of the drawings, the amount of grinding force which the grinding rolls 20 apply to the coal on the grinding table 16 is a function of the amount of force with which the grinding rolls 20 are biased into engagement with the coal on the table 16. Moreover, in accord with the nature of the construction shown in FIG. 1, the grinding roll 20 depicted therein, which is suitably mounted for rotation on a shaft (not shown), is suitably supported so as to be pivotably about the pivot pin 46 into and out of engagement with the coal that is disposed on the grinding table 16. Although only one grinding roll 20 is shown in FIG. 1 and although this discussion is directed to this one grinding roll 20, it is to be understood that the bowl mill 10 commonly is provided with a plurality of such grinding rolls 20, e.g., preferably three in number, and that this discussion is equally applicable to each of the plurality of grinding rolls 20.

Continuing with the matter of the force exerted by the grinding roll 20, in accord with the nature of the construction illustrated in FIG. 1, the grinding roll 20 is designed to be biased hydraulically into and out of engagement with the coal that is on the grinding table 16. More specifically, to this end a hydraulic means 22 is cooperatively associated with the grinding roll 20. As shown in FIG. 1, the hydraulic means 22 includes a cylinder 48 suitably mounted to the exterior wall surface of the separator body 14. Within the cylinder 48, a piston 50 is suitably supported for movement therewithin. Attached to the piston 50 is a piston rod 52 of sufficient length so as to extend into the interior of the separator body 14 whereupon the free end of the piston rod 52 engages an upstanding member 54 that comprises a portion of the support means for the grinding roll 20. A suitable opening 56 is formed in the separator body 14 to enable the piston rod 52 to project into the interior of the latter. In a manner well-known to those skilled in the art of hydraulics, the cylinder 48 is filled with a suitable hydraulic fluid, such that a hydraulic pressure is applied by the latter to both faces of the piston 50. The hydraulic fluid which fills the cylinder 48 is provided thereto from a suitable source thereof to which further reference will be had hereinafter.

Accordingly, the extent to which the free end of the piston rod 52 projects into the interior of the separator body 14 for engagement with the member 54 is a function of the difference in hydraulic pressure, which is applied to the faces of the piston 50. In turn, the extent to which the free end of the piston rod 52 extends into the interior of the separator body 14 determines the extent to which the grinding roll 50 is hydraulically biased into engagement with the coal on the grinding table 16, and concomitantly the amount of grinding force being applied to the coal by the grinding roll 20. That is, the piston rod 52 is fixedly attached to one face of the piston 50 such that as the piston 50 moves in response to the difference in hydraulic pressure being applied to the faces of the piston 50, the piston rod 52 moves along therewith. It is to be understood in this connection that the opening 56 provided in the separator body 14 through which the piston rod 52 passes is equipped with suitable sealing means (not shown) operative to prevent the leakage through the opening 56 of hydraulic fluid from the cylinder 48 to the interior of the body 14.

By way of exemplification, the more the free end of the piston rod 52 extends into the interior of the separator body 14, the more it will cause the member 54 to move in a clockwise direction, as viewed with reference to FIG. 1, about the pivot pin 46, and thereby have the effect of increasing the amount of grinding force that the grinding roll 20 exerts on the coal that is on the grinding table 16. Conversely, the less the free end of the piston rod 52 projects into the interior of the separator body 14, the less clockwise movement there will be of the member 54 about the pivot pin 46, and thus the less grinding force the roll 20 will exert on the coal that is resting on the table 16.

Lastly, in accord with the preferred form of construction, the hydraulic means 22 is provided with an accumulator 58. The function of the latter is to obviate any potentially damaging consequences that might otherwise flow from the occurrence of some form of transient operating component. For example, should some foreign object be introduced into the bowl mill 10 along with the coal to be pulverized, and should this foreign object become disposed on the grinding table 16, the effect of the grinding roll 20 engaging this foreign object would be to raise the roll 20 away from the table 16, i.e., would be to cause the roll 20 to move in a counterclockwise direction, as viewed with reference to FIG. 1, about the pivot pin 46. As a consequence thereof, the member 54 would be made to apply a force against the free end of the piston rod 52 tending to cause the piston 50 to move in a direction away from the wall surface of the separator body 14. Further, as the piston 50 moves in this manner, the hydraulic fluid located in that portion of the cylinder 48 towards which the piston 50 is moving would tend, absent the presence of the accumulator 58, to resist the movement of the piston 50. This could result in damage being incurred by the various components that are operatively associated with the grinding roll 20.

Accordingly, the function of the accumulator 58 is to permit hydraulic fluid to flow thereinto as the fluid is being forced from the cylinder 48 by the advancing piston 50. However, as soon as the grinding roll 20 passes over the foreign object, the grinding roll 20 is once again restored to its normal position, i.e., nontransient condition. This occurs by virtue of the flow from the accumulator 58 into the cylinder 48 of that hydraulic fluid which had been made to flow into the former from the latter, as a consequence of the counterclockwise movement, as viewed with reference to FIG. 1, of the grinding roll 20 about the pivot pin 46 caused by the raising of the roll 20 as the latter engaged and passed over the foreign object located on the grinding table 16.

Figure 2:
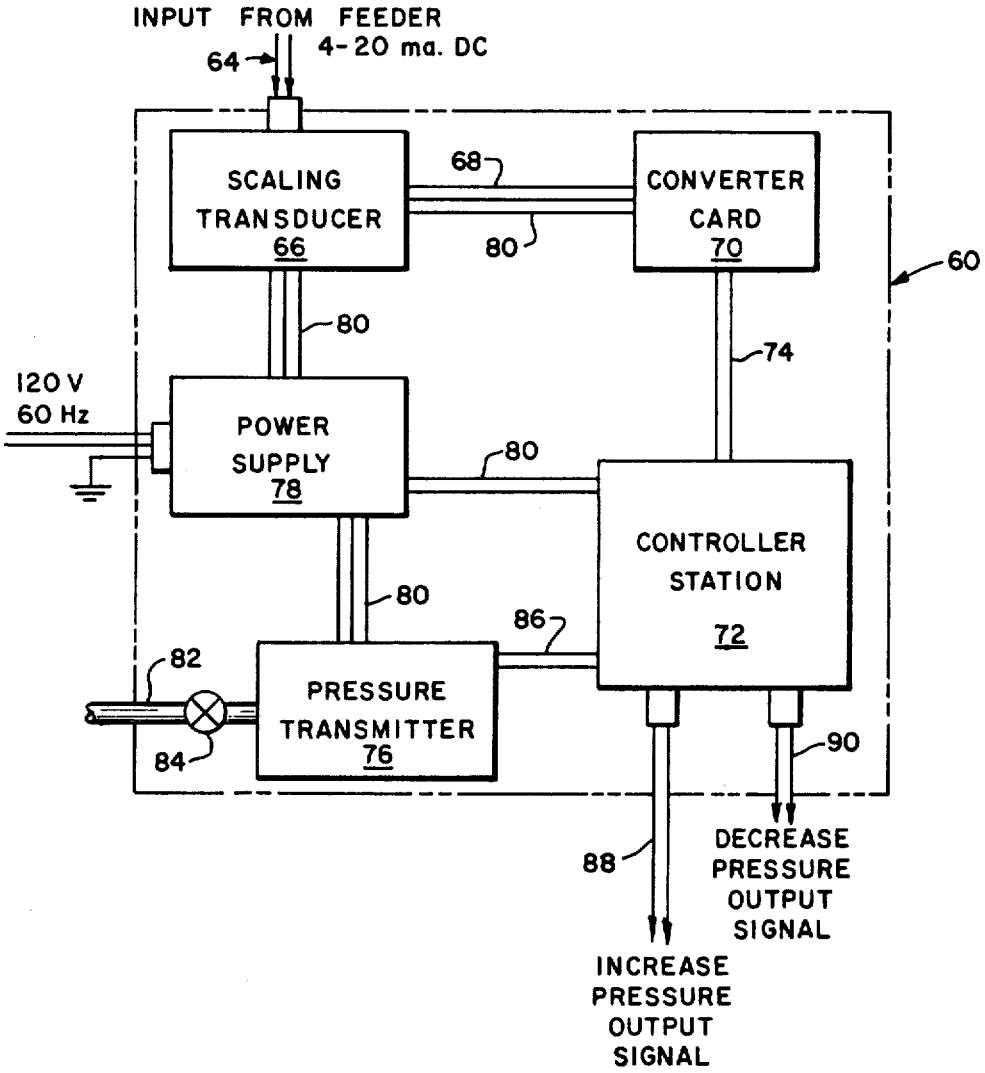
FIG. 2 is a schematic representation of the circuit means of an electronic controller constructed in accordance with the pressure invention.
Figure 3:
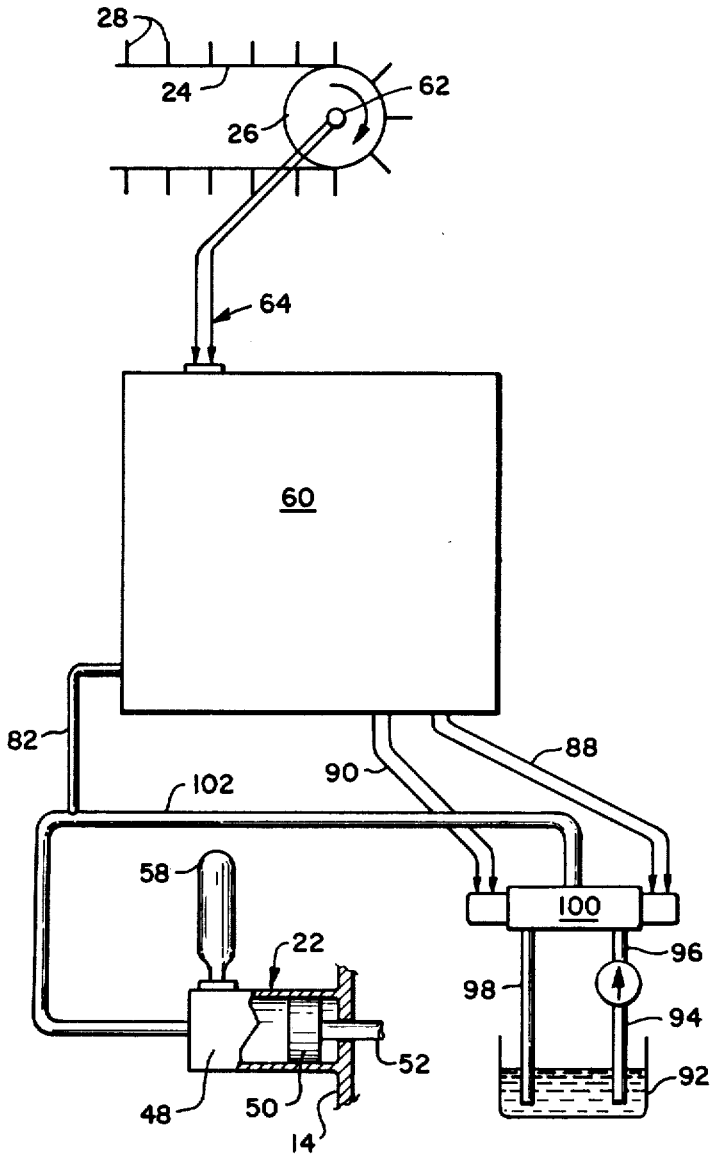
FIG. 3 is a schematic representation of an electronic controller constructed in accordance with the present invention illustrating the interconnection thereof with a belt feeder means and with a hydraulic power unit of a bowl mill.

Reference will now be had particularly to FIGS. 2 and 3 of the drawing for purposes of describing the electronic controller, generally designated by reference numeral 60, with which in accordance with the present invention a bowl mill constructed in the manner of the bowl mill of FIG. 1 is designed to be provided. More specifically, in accord with the present invention, the electronic controller 60 is operative to control the journal loading on the grinding rolls 20 of the bowl mill 10, and thereby the amount of grinding force that these rolls 20 exert on the coal disposed on the grinding table 16 for purposes of effecting the pulverization of this coal. This is accomplished, as will be described more fully hereinafter, by having the electronic controller 60 exercise control over the journal loading on the grinding rolls 20 in accordance with the rate at which coal is being fed, i.e., conveyed, by the belt feeder means 12 to the bowl mill 10.

With further reference to FIGS. 2 and 3, in accord with the best mode embodiment of the invention the electronic controller 60 is operatively connected to both the belt feeder means 12 and the hydraulic means 22 of the bowl mill 10. More specifically, the electronic controller 60 is operatively connected to the belt feeder means 12 for purposes of sensing the rate at which the coal is being conveyed thereby to the bowl mill 10. In this regard, and with particular reference to FIG. 3, for purposes of illustration, the electronic controller 60 is depicted as being operatively connected to the shaft 62 of the roller 26. However, inasmuch as the rate at which coal is being conveyed to the bowl mill 10 by the belt feeder means 12 is a function of the rate of movement of the endless belt 24 which in turn is a function of the rate of rotation of the roller 26 with the latter being a function of the rate of revolution of the shaft 62, it is to be understood that the electronic controller 60 could equally as well be depicted as being directly connected to either the endless belt 24 or the roller 26 without departing from the essence of the invention.

In accord with the illustrated embodiment of the invention, the rate of revolution of the shaft 62 is sensed by means of any suitable conventional form of sensing means and an electrical signal is generated thereby corresponding to the speed of rotation of the shaft 62. This electrical signal, which preferably is in the form of a 4–20 ma. DC electric current, is transmitted through the electrical wiring, schematically shown in FIG. 3 and denoted therein by the reference numeral 64, to the scaling transducer 66 of the electronic controller 60. The function of the scaling transducer 66, as its name implies, is to take the electrical signal received thereby and to effect a processing thereof for purposes of transposing it to a suitable scale. Devices that function in the manner of the scaling transducer 66 are commercially available under the model designation SC-1398CX.

Thereafter, the electrical signal as modified to reflect the scale transposition that has been applied thereto in the scaling transducer 66 is transmitted through the electrical wiring shown in FIG. 2 at 68 to the converter card 70. The function of the converter card 70 is to further process the electrical signal, which has been received thereby, to place the signal in a suitable form for presentation to the controller station 72. Devices that function in the manner of the converter card 70 are commercially available under the model designation 138861B. From the converter card 70, the electrical signal is then transmitted by means of the electrical wiring, designated 74 in FIG. 2, to the controller station 72 wherein it constitutes one of the inputs received by the latter.

As will be best understood with reference to FIG. 2 of the drawing, the electrical power that is required in the operation of the scaling transducer 66, the converter card 70, the controller station 72, and the yet to be described pressure transmitter 76 is supplied to each of the above-named components by a power supply, denoted by the reference numeral 78 in FIG. 2. More specifically, suitable electrical wiring designated by reference numeral 80 in FIG. 2 serves to interconnect the power supply 78 in electrical circuit relation with the following components: the scaling transducer 66, the converter card 70, the controller station 72 and the pressure transmitter 76. In turn, the power supply 78 receives its power from a suitable, externally located, electrical power source (not shown), which preferably is capable of supplying the power supply 78 with 120 v., 60 HZ. electric power. A power supply of the type denoted by the number 78 in FIG. 2 is commercially available under the model designation 30683383-001.

From the above, one should now readily be capable of understanding that the controller station 72 is provided with one input in the form of an electrical signal that is representative of the rate at which coal is being fed to the bowl mill 10 by the belt feeder means 12. However, in order to make proper use of the information represented by the aforesaid input for purposes of exercising control over the pressure of the hydraulic fluid contained in cylinder 48, and ultimately therefore, the amount of grinding force that the grinding rolls 20 exert on the coal disposed on the grinding table 16 for purposes of effecting the pulverization of this coal, it is also necessary that the controller station 72 be provided with an indication of the pressure of the hydraulic fluid in the cylinder 48. More specifically, there is a need for establishing a reference point in terms of the hydraulic pressure which exists within the cylinder 48.

To this end, as best understood with reference to FIG. 3, the pressure transmitter 76 of the electronic controller 60 is suitably connected in fluid flow relation with the cylinder 48 by means of the interconnection of the hydraulic line 82 with the hydraulic line 102, the former being connected directly to the pressure transmitter 76 and the latter being connected directly to the cylinder 48. Further, in accord with the illustrated embodiment of the invention a suitable valve, denoted in FIG. 2 by reference numeral 84, which is operable in the manner of a shut-off device, is preferably interposed in the line 82 intermediate the pressure transmitter 76 and the interconnection of the line 82 with the line 102. Accordingly, the pressure in the cylinder 48 is sensed through the use of any suitable conventional form of sensing means. With the valve 84 in the open condition, this sensing is transmitted through the lines 102 and 82 to the pressure transmitter 76 in the form of a hydraulic signal.

The function of the pressure transmitter 76 is to convert the aforesaid hydraulic signal to an electrical signal whereupon the latter is transmitted through the electrical wiring identified in FIG. 2 by the reference numeral 86 to the previously referenced controller station 72. More specifically, the electrical signal generated by the pressure transmitter 76 forms a second input to the controller station 72. Devices that function in the manner of the pressure transmitter 76 are commercially available under the model designation 41224-3001-13-00.

Being provided in the aforedescribed manner with two inputs, one corresponding to the rate at which the coal is being fed to the bowl mill 10 by the belt feeder means 12, and the other corresponding to the pressure of the hydraulic fluid in the cylinder 48, the controller station 72 processes the information represented by these two inputs and compares it to a pre-established bank of data stored therein. Further, based on this comparison the controller station 72, depending on the existing circumstances, operates to generate an output signal directing that the hydraulic pressure in the cylinder 48 be increased, or an output signal directing that the hydraulic pressure in the cylinder 48 be decreased, or in the event that no change in hydraulic pressure is necessitated no signal. That is, the controller station 72, based on the input signals provided thereto, is capable of generating an increase pressure electrical output signal denoted by the numeral 88 in FIG. 2, or a decrease pressure electrical output signal denoted by the numeral 90 in FIG. 2, or no signal in the event no pressure change is required.

These signals are transmitted to the hydraulic supply means from which the hydraulic fluid is fed to the cylinder 48. In accord with the best mode embodiment of the invention, the hydraulic supply means, as best understood with reference to FIG. 3, includes a supply tank 92, a solenoid-operated pump 94, a solenoid valve 100 and hydraulic lines 96, 98, and 102. Accordingly, depending upon the nature of the output signal that is received by the aforesaid hydraulic supply means from the controller station 72, a suitable response is generated by the former causing a corresponding increase or decrease in the hydraulic pressure in the cylinder 48.

By way of exemplification in this regard, at the commencement of the operation of the bowl mill 10, the hydraulic pressure in the cylinder 48 is established such that the hydraulic journal loading on the grinding roll 20 will cause the latter to exert substantially the optimum amount of grinding force on the coal that is disposed on the grinding table 16 in order to cause this coal to be pulverized to the desired degree based on the then existing operating conditions. Once the desired level of hydraulic pressure in the cylinder 48 has been attained, the solenoid valve 100 is made to occupy a neutral position. In this neutral position, no flow of hydraulic fluid occurs through the solenoid valve 100 either to or from the supply tank 92. Thereafter, the electronic controller becomes operative to exercise control over the hydraulic journal loading on the grinding roll 20.

To this end, assume that a change occurs in the rate of feed of the coal by the belt feeder means 12 to the bowl mill 10 that necessitates a change in the journal loading on the grinding roll 20 in order to maintain the latter in a condition of exerting substantially the optimum amount of grinding force on the coal that is disposed on the grinding table 16. The need for such a change would be sensed by the sensing means associated with the shaft 62, and a suitable electrical signal would be generated thereby and transmitted to the scaling transducer 66. After being processed thereby and also by the converter card 70, as described previously hereinabove, the electrical signal would be transmitted in the form of an input to the controller station 72. The latter upon receiving this input as well as an input from the pressure transmitter 76 indicating the level of the hydraulic pressure then existing in the cylinder 48 would determine whether a need existed to effect a change in the hydraulic pressure in the cylinder 48.

For purposes of the above illustration, it has been assumed that such a need did exist to increase the hydraulic pressure in the cylinder 48. Accordingly, a suitable signal in the form of an increase pressure output signal would be generated by the controller station 72 and transmitted therefrom through the electrical wiring 88 to the solenoid valve 100. This signal would be operative to actuate the operation of the solenoid-operated pump 94 as well as cause the solenoid valve 100 to occupy a position wherein hydraulic fluid pumped from the supply tank 92 by the pump 94 would flow from the line 96 through the solenoid valve 100, and from the latter through line 102 to the cylinder 48. This would continue until such time as the desired increased level of hydraulic pressure in the cylinder 48 was attained, whereupon the solenoid valve 100 would once again occupy its neutral position.

Assume now that the rate of feed of the coal to the bowl mill 10 by the belt feeder means 12 were to change, necessitating a decrease in the hydraulic pressure in the cylinder 48, the same process as that described above would be followed except that in place of generating an increase pressure output signal, the controller station 72 would produce a decrease pressure output signal. The latter signal would be transmitted through the wiring 90 from the controller station 72 to the solenoid valve 100. The effect on the solenoid valve 100 of receiving this signal would be to cause the latter to move from a neutral position to one wherein hydraulic fluid would flow from the cylinder 48 through the line 102 to the solenoid valve 100, and through the latter and line 98 to the supply tank 92. Once the desired decreased level of hydraulic pressure was attained in the cylinder 48, the solenoid valve 100 would be restored to its neutral position.

It is important to take note here once again of the fact that prior art forms of hydraulic systems which have been utilized in connection with bowl mills heretofore have been designed to function as servo systems; namely to ensure that a constant hydraulic pressure level is maintained in the hydraulic cylinder such that thereby the grinding rolls of these bowl mills are caused to exert the same amount of grinding force for varying rates of feed of the coal to these bowl mills. In contrast thereto, the electronic controller 60 constructed in accordance with the present invention is operative to enable the grinding rolls 20 to exert different amounts of grinding force according to the rate at which coal is being supplied to the bowl mill 10 by the belt feeder means 12. Further to this point, the pre-established bank of data which is stored in the controller station 72 essentially may be viewed as constituting a set of data points, i.e., a compilation of previously made calculations, representative of the hydraulic pressure which should exist in the cylinder 48 in order to establish a hydraulic journal loading on the grinding rolls 20 that will cause the latter to exert substantially the optimum amount of grinding force required to effect the desired degree of pulverization of the coal disposed on the grinding table 16 in accordance with the particular rate at which the coal to be pulverized is being fed to the bowl mill 10 by the belt feeder means 12. In summary, the electronic controller 60 constructed in accord with the present invention is operative to cause the proper hydraulic journal loading to be established on the grinding roll 20 in order to cause the latter to exert substantially the optimum amount of grinding force on the coal disposed on the grinding table 16 to effect the desired degree of pulverization of the coal for each different rate of feed of coal to the bowl mill 10 by the belt feeder means 12. This is accomplished automatically by the electronic controller 60 based on a sensing of the rate of feed of coal to the bowl mill 10 by the belt feeder means 12 derived by sensing the rate of rotation of the shaft 62, and a sensing of the hydraulic pressure which exists in the cylinder 48, and a comparison of the information derived from these two sensings with a preprogrammed bank of data with which the electronic controller 60 and more particularly the controller station 72 thereof is provided. Finally, although only one grinding roll 20 and one electronic controller 60 have been depicted in the Figures of the drawing, it is to be understood that the bowl mill 10 in accord with the best mode embodiment of the invention would embody three such grinding rolls 20 and each one thereof would have an electronic controller 60 cooperatively associated therewith for purposes of exercising control over the hydraulic journal loading that is applied thereto.

Thus, in accordance with the present invention there has been provided a new and improved means operable for establishing the journal loading on the grinding rolls of a bowl mill that is suitable for use to pulverize coal. Moreover, the subject means with which such a bowl mill is provided is operative to establish a hydraulic loading on the grinding rolls of the bowl mill. In addition, in accord with the present invention such a means is provided in the form of an electronic controller that is operative for purposes of effecting control over the hydraulic loading that is applied to the grinding rolls of the bowl mill. Further, the electronic controller of the present invention is capable of obviating the problem involving the failure to meet quality assurance standards that has served to disadvantageously characterize the mechanical coil springs that have been employed heretofore for purposes of establishing the journal loading on the grinding rolls in a bowl mill. Additionally, in accordance with the present invention an electronic controller is provided that is capable of obviating the problem involving susceptibility to hunting that has served to disadvantageously characterize the hydraulic systems that have been employed heretofore for purposes of establishing the journal loading on the grinding rolls in a bowl mill. Also, the electronic controller of the present invention is operative to enable adjustments to be made in the amount of grinding force being exerted by the grinding rolls in order to compensate for the occurrence of changes in the operating parameters of the bowl mill. Furthermore, in accord with the present invention an electronic controller is provided that is relatively simple to construct and employ as well as being relatively inexpensive to provide.

While only one embodiment of my invention has been shown, it will be appreciated that modifications thereof, some of which have been alluded to hereinabove, may still be readily made thereto by those skilled in the art. I, therefore, intend by the appended claims to cover the modifications alluded to herein as well as all the other modifications, which fall within the true spirit and scope of my invention.

What is claimed is:

1. In the combination of a bowl mill operative for pulverizing coal therewithin and a belt feeder means operative for feeding coal to the bowl mill, said bowl mill including a separator body, a grinding table supported on a shaft for rotation within the separator body, at least one grinding roll supported within the separator body so as to be operable to exert a grinding force on the coal disposed on the grinding table for purposes of effecting the pulverization thereof, and a hydraulic fluid means cooperatively associated with the grinding roll and operative for purposes of establishing the hydraulic journal loading on the grinding roll that enables the grinding roll to apply grinding force to the coal on the grinding table, the improvement comprising an electronic controller for effecting control over the hydraulic journal loading applied to the grinding roll in accordance with the rate at which coal is fed to the bowl mill by the belt feeder means, said electronic controller comprising:

(a) first means cooperatively associated with the belt means and operative for deriving an electronic signal therefrom corresponding to the rate at which coal is being fed to the bowl mill by the belt feeder means;

(b) second means cooperatively associated with the hydraulic fluid means and operative for deriving a signal corresponding to the hydraulic pressure present in the hydraulic fluid means;

(c) a controller station having a pre-established bank of data stored therein corresponding to the optimum amount of grinding force that the grinding roll should exert for different rates of feed by the belt feeder means of coal to the bowl mill, said controller station being connected in circuit relation with said first means for receiving in the form of a first input the electrical signal derived by said first means, said controller station further being connected in circuit relation with said second means for receiving in the form of a second input the signal derived by said second means, said controller station being operative to compare the information received by said controller station in the form of the first and second inputs with the pre-established bank of data stored in said controller station, said controller station being operative based on this comparison to selectively produce an increase pressure output signal or a decrease pressure output signal or no output signal as required in order to cause the grinding roll to exert the optimum amount of grinding force for the particular rate of feed at which the belt feeder means is sensed to be feeding the coal to the bowl mill;

(d) hydraulic fluid supply means connected in fluid flow relation with the hydraulic fluid means, said hydraulic fluid supply means further being connected in circuit relation with said controller station;

(e) third means interconnecting said controller station with said hydraulic fluid supply means and operative for transmitting the increase pressure output signal produced by said controller station to said hydraulic fluid supply means to cause said hydraulic fluid supply means to supply hydraulic fluid therefrom to the hydraulic fluid means to cause the hydraulic pressure in the hydraulic fluid means to increase for purposes of effecting a concomitant increase in the grinding force exerted by the grinding roll such that the grinding force being exerted by the grinding roll represents the optimum grinding force for that particular rate of feed at which the belt feeder means is sensed to be feeding the coal to the bowl mill; and (f) fourth means interconnecting said controller station with said hydraulic fluid supply means and operative for transmitting the decrease pressure output signal produced by said controller station to said hydraulic fluid supply means to cause said hydraulic fluid supply means to receive hydraulic fluid from the hydraulic fluid means to cause the hydraulic pressure in the hydraulic fluid means to decrease for purposes of effecting a concomitant decrease in the grinding force exerted by the grinding roll such that the grinding force being exerted by the grinding roll represents the optimum grinding force for that particular rate of feed at which the belt feeder means is sensed to be feeding the coal to the bowl mill.

2. In the combination set forth in claim 1 wherein said electronic controller further includes a scaling transducer connected in electrical circuit relation with said first means for receiving therefrom the electrical signal derived by said first means, said scaling transducer being operative to transpose the electrical signal received thereby to a suitable scale.

3. In the combination set forth in claim 2 wherein said electronic controller further includes a converter card connected in electrical circuit relation with said scaling transducer and said controller station for receiving the electrical signal from said scaling transducer and for transmitting the electrical signal to said controller station, said converter card being operative to impart further processing to the electrical signal preparatory to the electrical signal being provided as a first input to said controller station.

4. In the combination set forth in claim 3 wherein said electronic controller further includes a pressure transmitter connected in fluid flow relation with said second means for receiving therefrom the signal derived by said second means and in circuit relation with said controller station, said pressure transmitter being operative to transmit the signal received thereby from said second means to said controller station as a second input thereto.

5. In the combination set forth in claim 4 wherein said electronic controller further includes a power supply connected in electrical circuit relation with each of said scaling transducer, said converter card, said controller station and said pressure transmitter, said power supply being operative to provide each of said scaling transducer, said converter card, said controller station and said pressure transmitter with the electrical power required for the operation thereof.

6. In the combination set forth in claim 1 wherein said hydraulic fluid supply means includes a supply tank containing a supply of hydraulic fluid.

7. In the combination set forth in claim 6 wherein said hydraulic fluid supply means further includes a solenoid valve connected in fluid flow relation with said supply tank and with the hydraulic fluid means, said solenoid valve being movable between a plurality of operating positions including a first position, a second position and a neutral position.

8. In the combination set forth in claim 7 wherein said hydraulic fluid supply means further includes a solenoid-operated pump connected in fluid flow relation with said solenoid valve and with said supply tank, said solenoid-operated pump being operative to pump hydraulic fluid from said supply tank to and through said solenoid valve to the hydraulic fluid means.

9. In the combination set forth in claim 8 wherein said electronic controller further includes third means interconnecting said controller station with said solenoid valve, said third means being operative to convey the increase pressure output signal produced by said controller station therefrom to said solenoid valve to cause said solenoid valve to occupy said first position thereof wherein hydraulic fluid is pumped from said supply tank by said solenoid-operated pump to and through said solenoid valve to the hydraulic fluid means to cause the pressure of the hydraulic fluid in the hydraulic fluid means to increase.

10. In the combination set forth in claim 9 wherein said electronic controller further includes fourth means interconnecting said controller station with said solenoid valve, said fourth means being operative to convey the decrease pressure output signal produced by said controller station therefrom to said solenoid valve to cause said solenoid valve to occupy said second position thereof wherein hydraulic fluid is drained from the hydraulic fluid means to and through said solenoid valve to said supply tank to cause the hydraulic pressure of the hydraulic fluid in the hydraulic fluid means to decrease.

* * * * *